US008912972B2

(12) United States Patent
Ueki et al.

(10) Patent No.: US 8,912,972 B2
(45) Date of Patent: Dec. 16, 2014

(54) COUPLING DEGREE ADJUSTMENT CIRCUIT, ANTENNA DEVICE, AND WIRELESS COMMUNICATION DEVICE

(71) Applicant: Murata Manufacturing Co., Ltd., Nagaokakyo-shi, Kyoto-fu (JP)

(72) Inventors: Noriyuki Ueki, Nagaokakyo (JP); Noboru Kato, Nagaokakyo (JP); Kenichi Ishizuka, Nagaokakyo (JP); Hiroshi Nishida, Nagaokakyo (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 14/071,682

(22) Filed: Nov. 5, 2013

(65) Prior Publication Data

US 2014/0049440 A1 Feb. 20, 2014

Related U.S. Application Data

(63) Continuation of application No. PCT/JP2012/061591, filed on May 2, 2012.

(30) Foreign Application Priority Data

May 9, 2011 (JP) ..... 2011-103969

(51) Int. Cl.

| | |
|---|---|
| ***H01Q 21/06*** | (2006.01) |
| ***H01Q 21/00*** | (2006.01) |
| ***H01Q 1/36*** | (2006.01) |
| ***H01Q 1/40*** | (2006.01) |
| ***H01Q 5/00*** | (2006.01) |
| ***H01Q 21/30*** | (2006.01) |

(52) U.S. Cl.

CPC ..... *H01Q 21/0006* (2013.01); *H01Q 1/36* (2013.01); *H01Q 1/405* (2013.01); *H01Q 5/0051* (2013.01); *H01Q 5/0062* (2013.01); *H01Q 5/0065* (2013.01); *H01Q 21/30* (2013.01)

USPC ..... 343/852; 343/742; 343/853; 343/867

(58) Field of Classification Search

USPC ..... 343/700 MS, 745, 741, 742, 788, 852, 343/853, 866, 867

See application file for complete search history.

(56) References Cited

U.S. PATENT DOCUMENTS 2,183,562 A * 12/1939 Hansell ..... 455/19
2,217,413 A * 10/1940 Koschmieder ..... 343/847

(Continued)

FOREIGN PATENT DOCUMENTS

CN 1661855 A 8/2005
CN 101730957 A 6/2010

(Continued)

OTHER PUBLICATIONS

Official Communication issued in International Patent Application No. PCT/JP2012/061591, mailed on Jul. 24, 2012.

(Continued)

*Primary Examiner* — Tho G Phan
(74) *Attorney, Agent, or Firm* — Keating & Bennett, LLP

(57) ABSTRACT

A dielectric body includes a first radiating element on a first side and a second radiating element on a second side. The first radiating element and the second radiating element are linear conductors that each extend from a first end to a second end (an open end), and are parallel or substantially parallel to each other in a direction from the first end to the second end. The first end of the first radiating element is connected to a first port of a coupling degree adjustment circuit, and the first end of the second radiating element is connected to a second port of the coupling degree adjustment circuit. The first radiating element and the second radiating element are mainly coupled to each other in the coupling degree adjustment circuit.

20 Claims, 20 Drawing Sheets

(56) References Cited

U.S. PATENT DOCUMENTS

| | | | | |
|---|---|---|---|---|
| 2,320,124 | A * | 5/1943 | Forbes | 455/193.2 |
| 5,105,201 | A * | 4/1992 | Nakase et al. | 343/715 |
| 2002/0196192 | A1 | 12/2002 | Nagumo et al. | |
| 2005/0190107 | A1 | 9/2005 | Takagi et al. | |
| 2014/0062819 | A1 | 3/2014 | Montgomery et al. | |

FOREIGN PATENT DOCUMENTS

| | | | |
|---|---|---|---|
| JP | 6-69715 | A | 3/1994 |
| JP | 2000-244273 | A | 9/2000 |
| JP | 2003-8326 | A | 1/2003 |
| JP | 2003-51705 | A | 2/2003 |
| JP | 2004-304615 | A | 10/2004 |
| JP | 2011-4234 | A | 1/2011 |
| JP | 2012-105125 | A | 5/2012 |

OTHER PUBLICATIONS

Official Communication issued in corresponding Chinese Patent Application No. 201280022522.0, mailed on Jun. 27, 2014.

* cited by examiner

COUPLING DEGREE ADJUSTMENT CIRCUIT, ANTENNA DEVICE, AND WIRELESS COMMUNICATION DEVICE

BACKGROUND OF THE INVENTION

1. Field of the Invention

The present invention relates to a coupling degree adjustment circuit, an antenna device for multiband, and a communication terminal apparatus equipped with the antenna device.

2. Description of the Related Art

Japanese Unexamined Patent Application Publication No. H06-069715 and Patent Literature Japanese Unexamined Patent Application Publication No. 2003-008326 disclose multiple resonant antennas in which a radiating element and a radiating element are coupled to each other for the purpose of expanding applicable frequency bands. In these multiple resonant antennas, a feeding element and a non-feeding element are parallel to each other in a region in which a magnetic field component is increased and are made magnetically coupled to each other so that each element can act as a radiating element.

The typical configuration of the conventional multiple resonant antennas as disclosed in Japanese Unexamined Patent Application Publication No. H06-069715 and Japanese Unexamined Patent Application Publication No. 2003-008326, as illustrated in FIG. 1A, includes a first radiating element RE1 as a feeding element, and a second radiating element RE2 as a non-feeding element, makes the vicinity of a feeding portion of the first radiating element RE1 and the vicinity of a ground end of the second radiating element RE2 close and in parallel to each other so as to cause the elements to be magnetically coupled to each other.

When a resonant frequency of the first radiating element RE1 is set to f1 and a resonant frequency of the second radiating element RE2 is set to f2, and the first radiating element RE1 and the second radiating element RE2 are coupled to each other, as illustrated in FIG. 1B, the second radiating element RE2 resonates at f2. The return loss characteristic of this whole multiple resonant antenna shows the combination of a resonance characteristic of the first radiating element RE1 and a resonance characteristic of the second radiating element RE2, as illustrated as the solid line of FIG. 1B, and becomes a characteristic as illustrated by a solid line.

However, the strength of coupling between the first radiating element RE1 and the second radiating element RE2 is determined not only by a distance between the elements but under a condition in which the vicinity of a feeding portion of the first radiating element RE1 and the vicinity of a ground end of the second radiating element RE2 are close to each other and also arranged in parallel to each other. Therefore, the flexibility of the pattern of the first radiating element RE1 and the second radiating element RE2 is low. In addition, when the first radiating element RE1 and the second radiating element RE2 are arranged too close to each other, it becomes impossible to match a feeding circuit and the multiple resonant antenna and further, when other components (especially a metal article) exist near a portion in which the elements are parallel (a portion in which the elements are magnetically coupled), a problem that the degree of coupling of the first radiating element RE1 and the second radiating element RE2 may change arises.

SUMMARY OF THE INVENTION

In view of the above problems, preferred embodiments of the present invention provide a coupling degree adjustment circuit and an antenna device that increase design flexibility of a radiating element pattern and setting a degree of coupling between two radiating elements regardless of whether the radiating elements are close or not close, and a communication terminal apparatus equipped with the antenna device.

A coupling degree adjustment circuit according to a preferred embodiment of the present invention includes a primary side circuit that includes a first coil element and is connected to a first radiating element; and a secondary side circuit that includes a second coil element electromagnetically coupled to the first coil element, and is connected to a second radiating element.

An antenna device according to a preferred embodiment of the present invention includes a first radiating element; a second radiating element, and a coupling degree adjustment circuit connected between the first radiating element and the second radiating element, and a feeding circuit, the coupling degree adjustment circuit including a primary side circuit that includes a first coil element and is connected to the first radiating element; and a secondary side circuit that includes a second coil element electromagnetically coupled to the first coil element, and is connected to the second radiating element.

A communication terminal apparatus according to a preferred embodiment of the present invention includes an antenna device including a first radiating element; a second radiating element, and a coupling degree adjustment circuit connected between the first radiating element and the second radiating element, and a feeding circuit, the coupling degree adjustment circuit including a primary side circuit that includes a first coil element and is connected to the first radiating element; and a secondary side circuit that includes a second coil element electromagnetically coupled to the first coil element, and is connected to the second radiating element.

According to various preferred embodiments of the present invention, since it is not necessary to arrange a first radiating element and a second radiating element parallel to each other, the design flexibility of those patterns is increased. In addition, even if the first radiating element and the second radiating element are arranged close to each other, a degree of coupling can be set to a predetermined degree of coupling, so that a feeding circuit and a multiple resonant antenna can be easily matched.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

First Preferred Embodiment

Figure 1A:
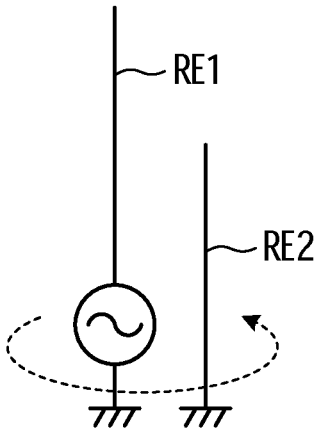
FIG.1A Prior Art
FIG. 1A is a view illustrating a typical configuration of a conventional multiple resonant antenna.
Figure 1B:
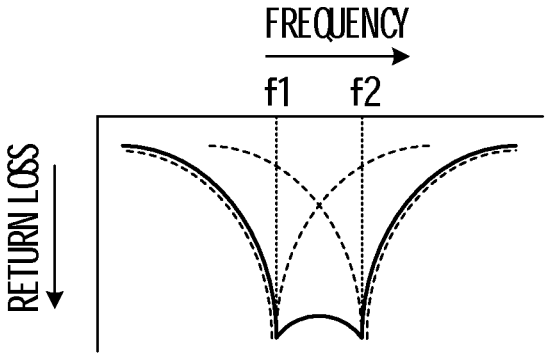
FIG. 1B is a view illustrating a return loss characteristic of the multiple resonant antenna.
Figure 2A:
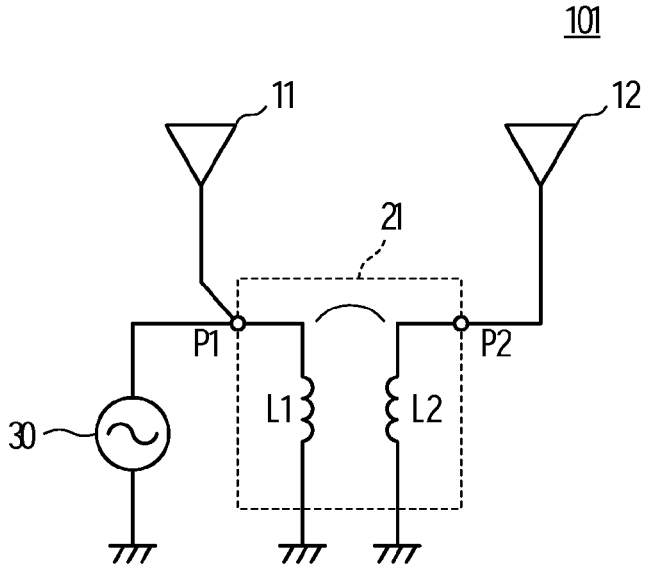
FIG. 2A and FIG. 2B are circuit diagrams of an antenna device 101 of a first preferred embodiment of the present invention.
Figure 2B:
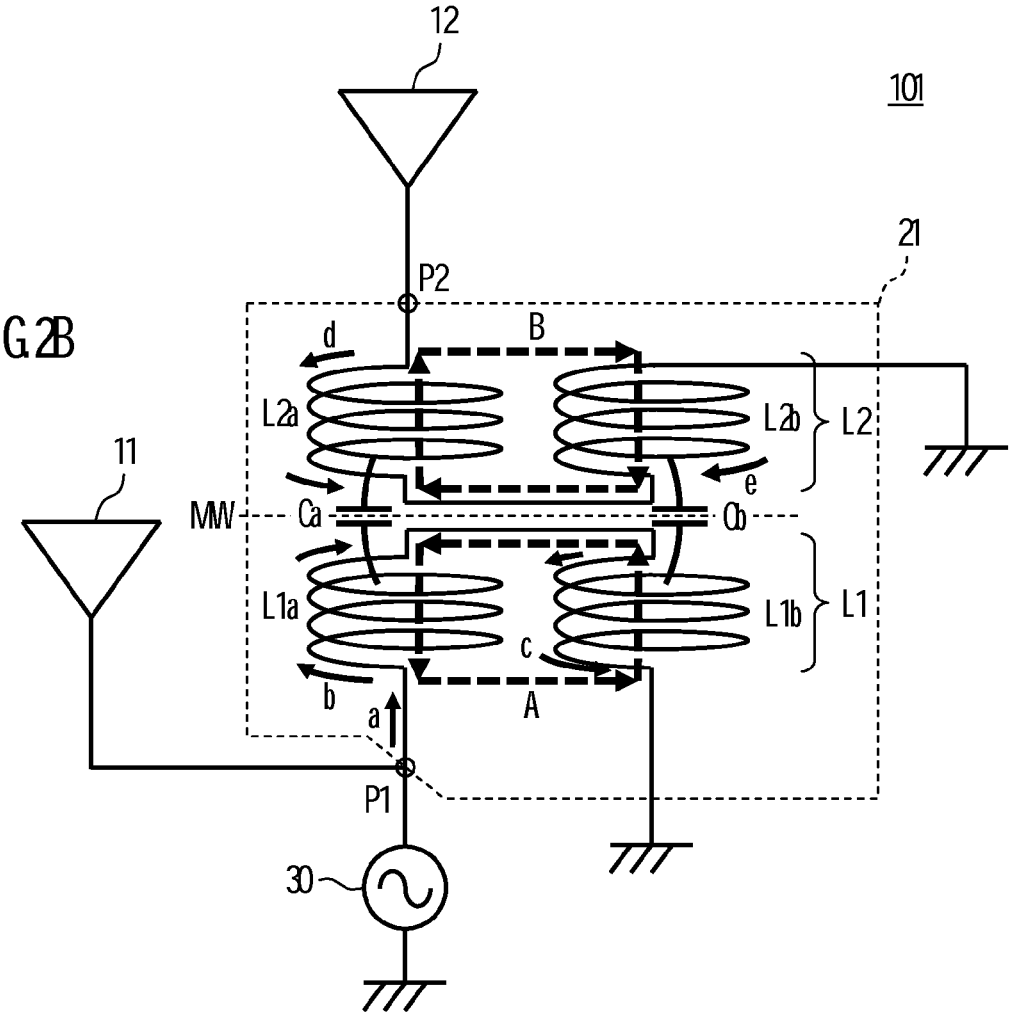

FIG. 2A and FIG. 2B are circuit diagrams of an antenna device 101 of a first preferred embodiment of the present invention. In FIG. 2A, a portion of a coupling degree adjustment circuit 21 is simplified and illustrated. In FIG. 2B, the configuration of the coupling degree adjustment circuit 21 is more specifically illustrated. This antenna device 101 includes the coupling degree adjustment circuit 21, a first radiating element 11, and a second radiating element 12. The first radiating element 11 is connected to a first port (a feeding port) P1 of the coupling degree adjustment circuit 21. The second radiating element 12 is connected to a second port P2 of the coupling degree adjustment circuit 21.

The coupling degree adjustment circuit 21 includes a primary side circuit including a first coil element L1, and a secondary side circuit including a second coil element L2. The first coil element L1 is connected to a first radiating element 11, and the second coil element L2 is connected to a second radiating element 12.

The coupling degree adjustment circuit 21 includes the first coil element L1 and the second coil element L2 that are electromagnetically coupled to each other. Thus, the first radiating element 11 and the second radiating element 12 are coupled through the coupling degree adjustment circuit 21. Then, a degree of coupling of the first radiating element 11 and the second radiating element 12 can be defined by a degree of coupling of the coupling degree adjustment circuit 21. The degree of coupling of the coupling degree adjustment circuit 21 can be defined by, for example, a coil distance between the first coil element L1 and the second coil element L2. While the electromagnetic field coupling of each coil element is coupling that is mainly performed through a magnetic field, electric field coupling may be partially included.

In particular, the operations of the coupling degree adjustment circuit 21 will be described with reference to FIG. 2B. As illustrated in FIG. 2B, the first coil element L1 includes coil elements L1*a* and L1*b*, and the second coil element L2 includes coil elements L2*a* and L2*b*. When a current is supplied from a feeding circuit 30 in a direction indicated by arrow a in the figure, a current flows in the coil element L1*a* in a direction indicated by arrow b in the figure and also a current flows in the coil element L1*b* in a direction indicated by arrow c in the figure. Those currents generate a magnetic flux passing through a closed magnetic circuit, as indicated by arrow A in the figure.

Since the coil element L1*a* and the coil element L2*a* share a coil winding axis, and the conductor patterns of these two coil elements are parallel or substantially parallel to each other in a plan view state (a state in which the elements are viewed in a direction of the coil winding axis), a magnetic field generated as a result of flowing of the current b in the coil element L1*a* is coupled to the coil element L2*a* and thus an induced current d flows in the coil element L2*a* in an opposite direction. Similarly, since the coil element L1*b* and the coil element L2*b* share a coil winding axis and are parallel or substantially parallel to each other, a magnetic field generated as a result of flowing of the current c in the coil element L1*b* is coupled to the coil element L2*b* and thus an induced current e flows in the coil element L2*b* in an opposite direction. Those currents generate a magnetic flux passing through a closed magnetic circuit, as indicated by arrow B in the figure.

Since the magnetic flux passing through the closed magnetic circuit by the coil elements L1*a* and L1*b* and the magnetic flux passing through the closed magnetic circuit by the coil elements L2*a* and L2*b* repel each other, an equivalent magnetic barrier MW is generated between the first coil element L1 and the second coil element L2.

The coil element L1*a* and the coil element L2*a* are also coupled to each other through an electric field. Similarly, the coil element L1*b* and the coil element L2*b* are also coupled to each other through an electric field. Accordingly, when alternating-current signals flow in the coil element L1*a* and the coil element L1*b*, electric-field coupling causes currents to be excited in the coil element L2*a* and the coil element L2*b*. Capacitors Ca and Cb in FIG. 2B each symbolically represent coupling capacitances for the electric-field coupling.

When an alternating current flows in the first coil element L1, the direction of a current flowing in the second coil element L2 as a result of the coupling through the magnetic field and the direction of a current flowing into the second coil element L2 as a result of the coupling through the electric field are the same. Accordingly, the first coil element L1 and the second coil element L2 are coupled to each other strongly through both the magnetic field and the electric field. In other words, it is possible to reduce the amount of loss and to transmit high frequency energy.

Figure 3:
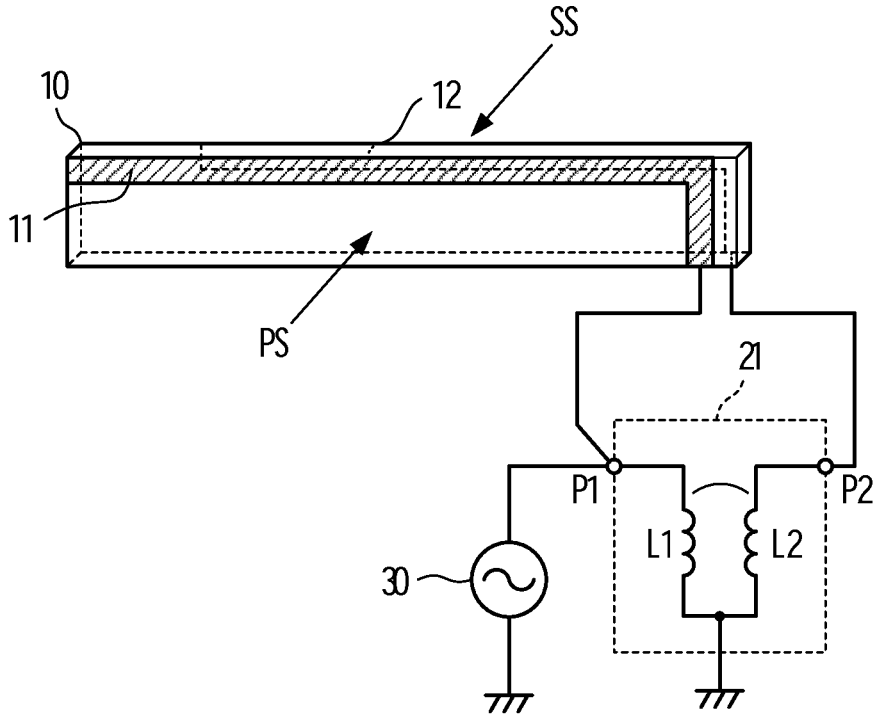
FIG. 3 is a view illustrating a configuration of the antenna device of the first preferred embodiment of the present invention.

FIG. 3 is a view illustrating a more specific example of a configuration of the antenna device of the first preferred embodiment of the present invention. In this example, a rectangular or substantially rectangular parallelepiped shaped dielectric body 10 includes a primary side PS on which the first radiating element 11 is provided, and a secondary side SS on which the second radiating element 12 is provided. The first radiating element 11 and the second radiating element 12 preferably are L-shaped or substantially L-shaped linear conductors that each extend from a first end to a second end (an open end). The first radiating element 11 and the second radiating element 12 are parallel or substantially parallel to each other in a direction from the first end to the second end (the open end), respectively. When the resonant frequency of the first radiating element 11 is represented by f1 and the resonant frequency of the second radiating element 12 is represented by f2 and a relationship f1<f2 is satisfied, the second radiating element 12 is shorter than the first radiating element 11.

The first end of the first radiating element 11 is connected to a first port P1 of the coupling degree adjustment circuit 21, and the first end of the second radiating element 12 is connected to a second port P2 of the coupling degree adjustment circuit 21. While the degree of coupling (without passing through the coupling degree adjustment circuit 21) between the first radiating element 11 and the second radiating element 12 preferably is about 0.2 to about 0.3, for example, the degree of coupling of the coupling degree adjustment circuit 21 preferably is not less than about 0.5 (desirably not less than about 0.7), for example. In this way, the degree of coupling between a primary side circuit and a secondary side circuit is higher than the degree of coupling between the first radiating element and the second radiating element without passing through the coupling degree adjustment circuit, so that the first radiating element 11 and the second radiating element 12 are mainly coupled to each other with the degree adjustment circuit 21.

It is to be noted that although it has been necessary to adjust a distance (a thickness of the dielectric body 10) between the first radiating element 11 and the second radiating element 12 in the conventional technique in order to adjust the degree of coupling between the first radiating element 11 and the second radiating element 12 formed in the dielectric body 10, according to a preferred embodiment of the present invention, a degree of coupling between the first coil element L1 and the second coil element L2 of the coupling degree adjustment circuit 21 can be used to adjust the degree of coupling between the first radiating element 11 and the second radiating element 12. Therefore, the pattern of the first radiating element 11 and the second radiating element 12 to the dielectric body 10, and the dielectric body 10 have a high flexibility in design.

Second Preferred Embodiment

Figure 4A:
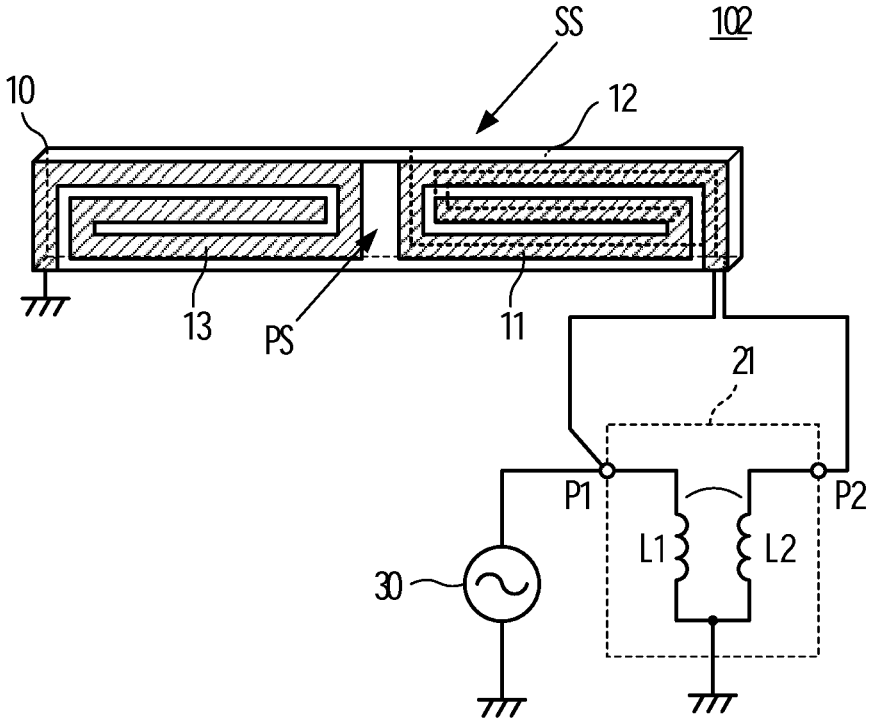
FIG. 4A is a configuration view of an antenna device 102 of a second preferred embodiment of the present invention.

FIG. 4A is a configuration view of an antenna device 102 of a second preferred embodiment of the present invention. The antenna device 102 includes the coupling degree adjustment circuit 21, a first radiating element 11, and a second radiating element 12. The coupling degree adjustment circuit 21 includes a primary side circuit including the first coil element L1 and a secondary side circuit including the second coil element L2, and the first coil element L1 and the second coil element L2 are electromagnetically coupled to each other.

A rectangular or substantially rectangular parallelepiped shaped dielectric body 10 includes a primary side PS on which a first radiating element 11 and a third radiating element 13 are provided; and a secondary side SS on which a second radiating element 12 is provided. The first radiating element 11 and the second radiating element 12 are conductors preferably each having a rectangular or substantially rectangular spiral shape. This first radiating element 11 and the second radiating element 12 are parallel or substantially parallel to each other in a direction from the first end to the second end (the open end), respectively. The third radiating element 13 is also a conductor having a rectangular or substantially rectangular spiral shape. The first end of the third radiating element 13 is arranged on a side far apart each other from the first end of the first radiating element 11 and the second radiating element 12. The third radiating element 13 is coupled to the first radiating element 11 through an electromagnetic field.

The first radiating element 11 is connected to a first port (a feeding port) P1 of the coupling degree adjustment circuit 21. The second radiating element 12 is connected to a second port P2 of the coupling degree adjustment circuit 21. Thus, the first radiating element 11 and the second radiating element 12 are coupled through the coupling degree adjustment circuit 21. Then, the degree of coupling of the first radiating element 11 and the second radiating element 12 is determined by the degree of coupling of the coupling degree adjustment circuit 21. In addition, since being partially close to each other, the first radiating element 11 and the third radiating element 13 are electromagnetically coupled. Then, the degree of coupling of the first radiating element 11 and the third radiating element 13, if each of the patterns are not changed, is determined by a mutual close distance.

When the resonant frequency of the first radiating element 11 is represented by f1, the resonant frequency of the second radiating element 12 is represented by f2, and the resonant frequency of the third radiating element 13 is represented by f3, the relationship f3<f1<f2 is satisfied in this example.

Figure 4B:
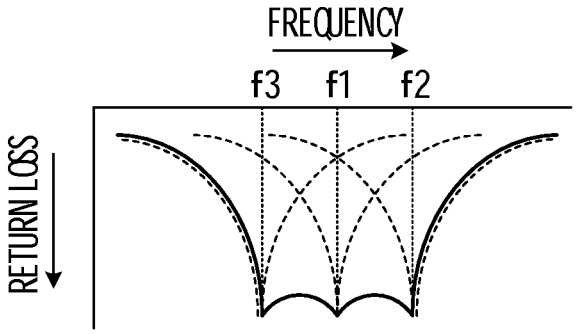
FIG. 4B shows a return loss characteristic of the antenna device 102 as viewed from a feeding circuit.

FIG. 4B shows a return loss characteristic of the antenna device 102 as viewed from a feeding circuit. The return loss characteristic of this antenna device are illustrated by combination of the resonance characteristic of the first radiating element RE1, the resonance characteristic of second radiating element RE2, and the resonance characteristic of third radiating element RE3 that are illustrated by a dashed line in FIG. 4B, and becomes a frequency characteristic of a wide band as illustrated by the solid line of FIG. 4B.

Third Preferred Embodiment

Figure 5:
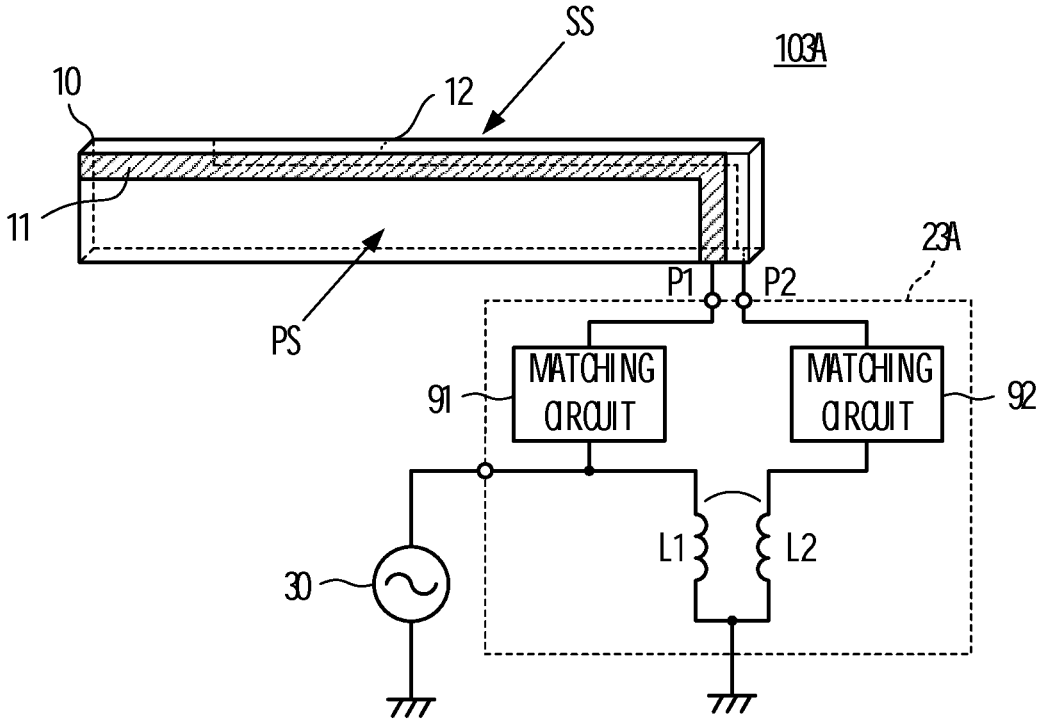
FIG. 5 is a configuration view of an antenna device 103A according to a third preferred embodiment of the present invention.

FIG. 5 is a configuration view of an antenna device 103A according to a third preferred embodiment of the present invention. This antenna device 103A includes a coupling degree adjustment circuit 23A, a first radiating element 11, and a second radiating element 12. The coupling degree adjustment circuit 23A includes a primary side circuit including a first coil element L1 and a secondary side circuit including a second coil element L2, and the first coil element L1 and the second coil element L2 are electromagnetically coupled to each other. The first radiating element 11 is provided on a primary side PS of a rectangular or substantially rectangular parallelepiped shaped dielectric body 10, and the second radiating element 12 is provided on a secondary side SS of the dielectric body 10. The first radiating element 11 and the second radiating element 12 preferably are L-shaped or substantially L-shaped linear conductors that each extend from a first end to a second end (an open end). The first radiating element 11 and the second radiating element 12 are parallel or substantially parallel to each other in a direction from the first end to the second end (the open end), respectively.

The coupling degree adjustment circuit 23A is connected between the first radiating element 11 and the second radiating element 12, and a feeding circuit 30. A first matching circuit 91 is connected between the first coil element L1 of the coupling degree adjustment circuit 23A and the first radiating element 11. In addition, a second matching circuit 92 is connected between the second coil element L2 of the coupling degree adjustment circuit 23A and the second radiating element 12. The first matching circuit 91 matches the impedance of the first coil element L1 of the coupling degree adjustment circuit 23A and the impedance of the first radiating element 11. The second matching circuit 92 matches the impedance of the second coil element L2 of the coupling degree adjustment circuit 23A and the impedance of the second radiating element 12.

Thus, the first radiating element 11 and the second radiating element 12 are coupled through the coupling degree adjustment circuit 23A. Then, the degree of coupling of the first radiating element 11 and the second radiating element 12 is determined by the degree of coupling of the coupling degree adjustment circuit 23A.

As described above, the first matching circuit 91 provided between the first coil element L1 of the coupling degree adjustment circuit 23A and the first radiating element 11 can match the impedance of the first coil element L1 of the coupling degree adjustment circuit 23A and the impedance of the first radiating element 11 according to the characteristic of the first radiating element 11. Similarly, the second matching circuit 92 provided between the second coil element L2 of the coupling degree adjustment circuit 23A and the second radiating element 12 can match the impedance of the second coil element L2 of the coupling degree adjustment circuit 23A and the impedance of the second radiating element 12 according to the characteristic of the second radiating element 12. It is to be noted that these matching circuits may be preferably defined by a single element of an inductor or a capacitor, and may be preferably defined by an LC resonance circuit (a n-type, a T-type, a series-connected type, a parallel-connected type, and the like). The same may be applied to the preferred embodiments as described below.

Figure 6:
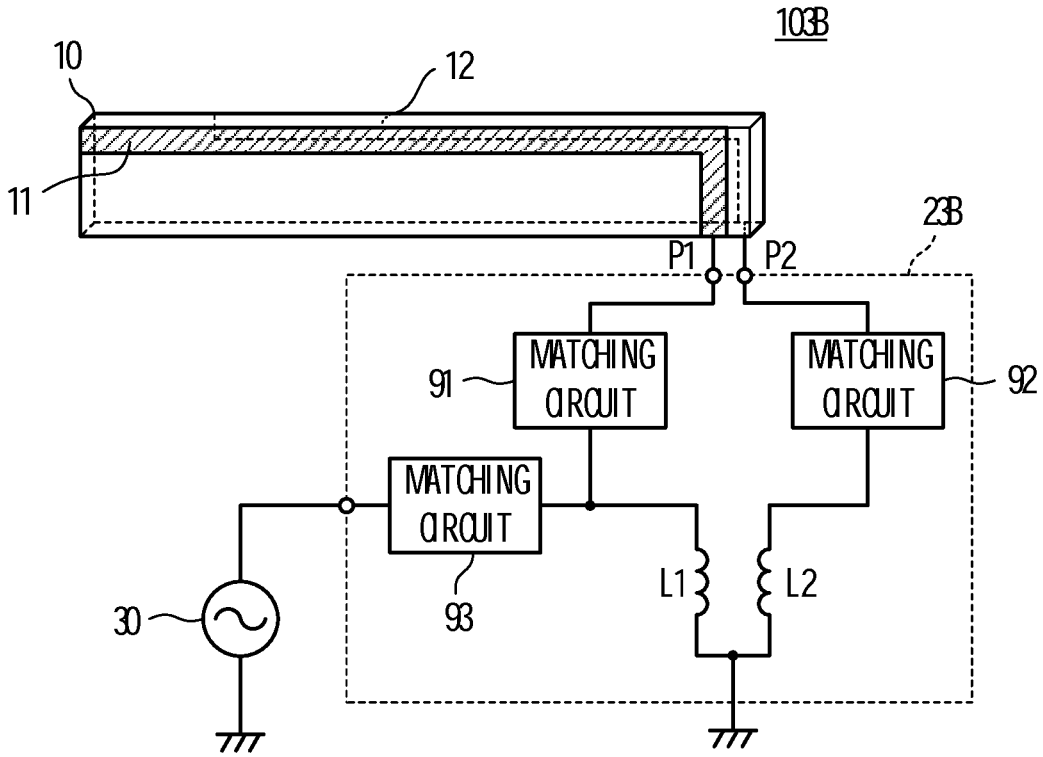
FIG. 6 is a configuration view of an antenna device 103B according to the third preferred embodiment of the present invention.

FIG. 6 is a configuration view of an antenna device 103B according to the third preferred embodiment of the present invention. This antenna device 103B includes a coupling degree adjustment circuit 23B, the first radiating element 11, and the second radiating element 12. The coupling degree adjustment circuit 23B includes the primary side circuit including the first coil element L1 and the secondary side circuit including the second coil element L2, and the first coil element L1 and the second coil element L2 are electromagnetically coupled to each other.

The coupling degree adjustment circuit 23B is connected between the first radiating element 11 and the second radiating element 12, and the feeding circuit 30. A first matching circuit 91 is connected between the first coil element L1 of the coupling degree adjustment circuit 23B and the first radiating element 11. In addition, a second matching circuit 92 is connected between the second coil element L2 of the coupling degree adjustment circuit 23B and the second radiating element 12. Furthermore, a third matching circuit 93 is connected between the first coil element L1 of the coupling degree adjustment circuit 23B and the feeding circuit 30. This third matching circuit 93 matches the impedance of the first coil element L1 of the coupling degree adjustment circuit 23B and the impedance of the feeding circuit 30. The other configurations and operations are the same as those of the antenna device 103A.

Figure 7:
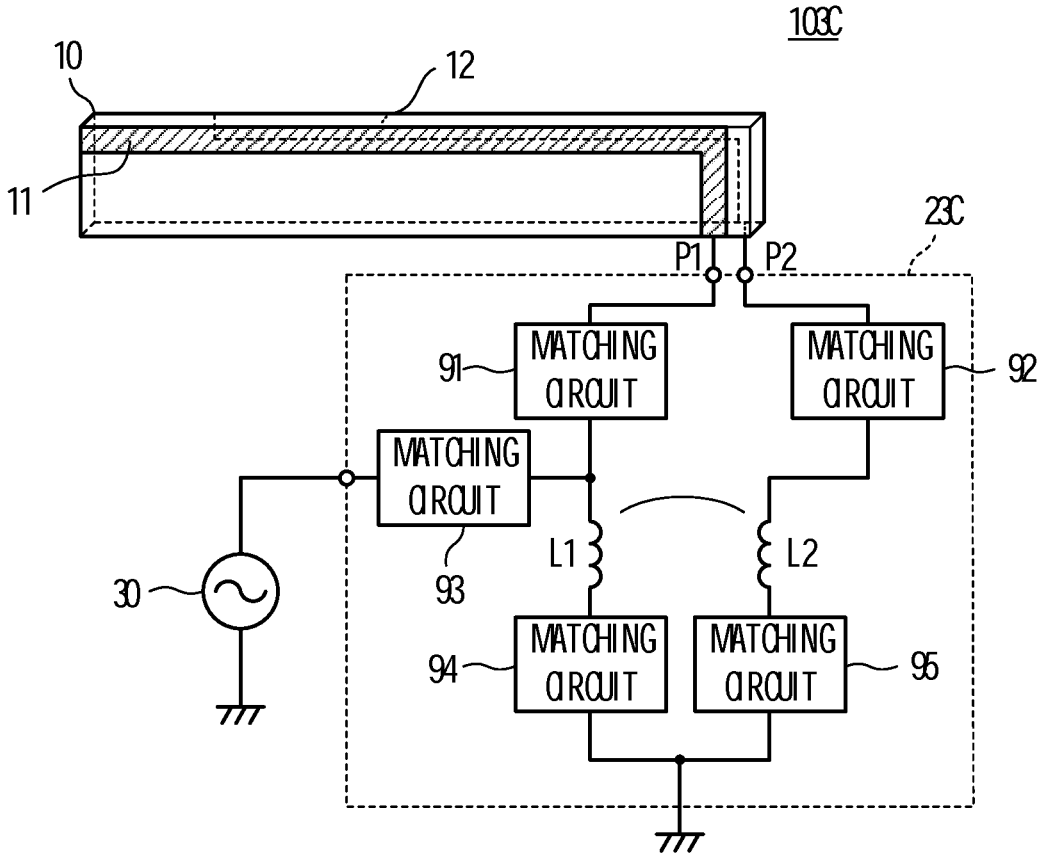
FIG. 7 is a configuration view of an antenna device 103C according to the third preferred embodiment of the present invention.

FIG. 7 is a configuration view of an antenna device 103C according to the third preferred embodiment of the present invention. This antenna device 103C includes a coupling degree adjustment circuit 23C, the first radiating element 11, and the second radiating element 12. The coupling degree adjustment circuit 23C includes the primary side circuit including the first coil element L1 and the secondary side circuit including the second coil element L2, and the first coil element L1 and the second coil element L2 are electromagnetically coupled to each other.

The coupling degree adjustment circuit 23C is connected between the first radiating element 11 and the second radiating element 12, and the feeding circuit 30. A first matching circuit 91 is connected between the first coil element L1 of the coupling degree adjustment circuit 23C and the first radiating element 11. In addition, a second matching circuit 92 is connected between the second coil element L2 of the coupling degree adjustment circuit 23C and the second radiating element 12. Moreover, a third matching circuit 93 is connected between the first coil element L1 of the coupling degree adjustment circuit 23C and the feeding circuit 30. In addition, a fourth matching circuit 94 is connected between the first coil element L1 of the coupling degree adjustment circuit 23C and ground. Furthermore, a fifth matching circuit 95 is connected between the second coil element L2 of the coupling degree adjustment circuit 23C and the ground. The first matching circuit 91, the third matching circuit 93, and the fourth matching circuit 94 provide impedance matching between the first coil element L1 of the coupling degree adjustment circuit 23C and the feeding circuit 30, and impedance matching between the first coil element L1 and the first radiating element 11. The second matching circuit 92 and the fifth matching circuit 95 provide impedance matching between the second coil element L2 of the coupling degree adjustment circuit 23C and the second radiating element 12. The other configurations and operations are the same as those of the antenna devices 103A and 103B.

Figure 8:
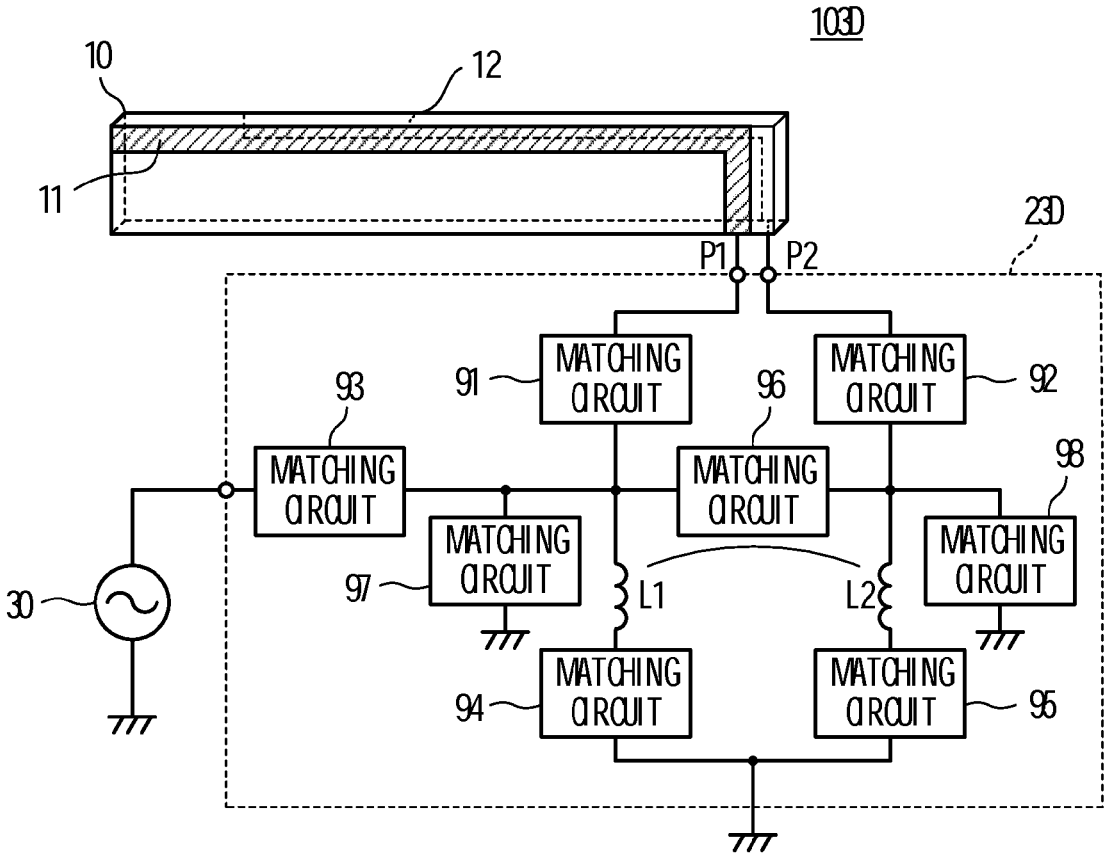
FIG. 8 is a configuration view of an antenna device 103D according to the third preferred embodiment of the present invention.

FIG. 8 is a configuration view of an antenna device 103D according to the third preferred embodiment of the present invention. The antenna device 103D includes a coupling degree adjustment circuit 23D, the first radiating element 11, and the second radiating element 12. The coupling degree adjustment circuit 23D includes the primary side circuit including the first coil element L1 and the secondary side circuit including the second coil element L2, and the first coil element L1 and the second coil element L2 are electromagnetically coupled to each other.

A sixth matching circuit 96 is connected between the first coil element L1 and the second coil element L2. In addition, a seventh matching circuit 97 is connected in shunt between the first coil element L1 and the feeding circuit 30. Further, an eighth matching circuit 98 is connected in shunt between the second coil element L2 and the second radiating element 12.

The sixth matching circuit 96 matches the first coil element L1 and the second coil element L2. The seventh matching circuit 97 together with the matching circuits 91, 93, and 94 matches the feeding circuit 30 and the first coil element L1. The eighth matching circuit 98 together with the matching circuits 92 and 95 matches the second coil element L2 and the second radiating element 12.

Fourth Preferred Embodiment

Figure 9:
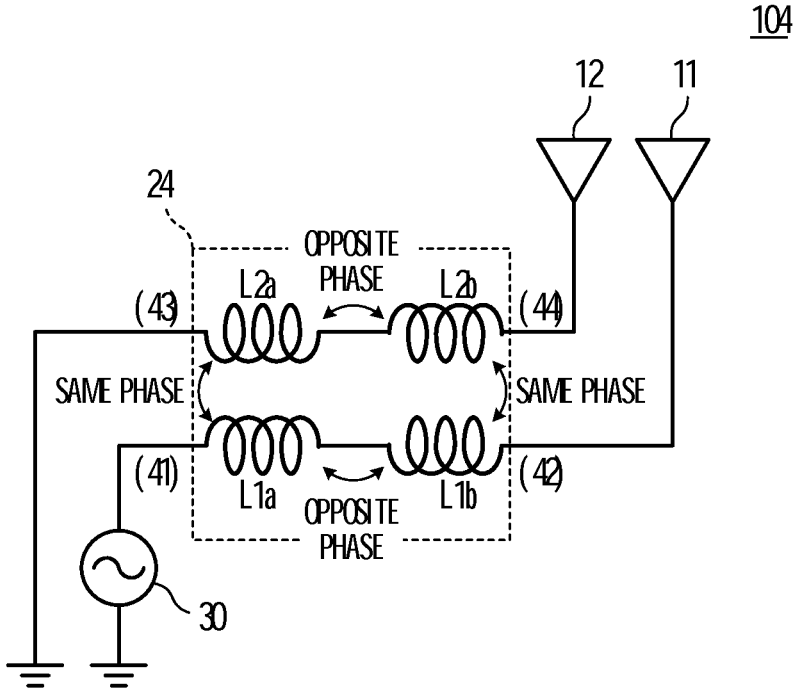
FIG. 9 is a circuit diagram of an antenna device 104 equipped with a coupling degree adjustment circuit 24 of a fourth preferred embodiment of the present invention.

FIG. 9 is a circuit diagram of an antenna device 104 equipped with a coupling degree adjustment circuit 24 of a fourth preferred embodiment of the present invention. In the fourth preferred embodiment, the primary side coil and the secondary side coil of the coupling degree adjustment circuit 24 are respectively defined by two coil elements. Then, the primary side circuit of the coupling degree adjustment circuit 24 is connected in series between the feeding circuit 30 and the first radiating element 11, and the second radiating element 12 is connected to the secondary side circuit of the coupling degree adjustment circuit 24.

In this example, the primary side coil and the secondary side coil are coupled (tightly coupled) to each other with a high degree of coupling. In other words, the primary side coil includes a coil element L1*a* and a coil element L1*b*, which are connected in series to each other and are wound so as to define a closed magnetic circuit. In addition, the secondary side coil includes a coil element L2*a* and a coil element L2*b*, which are connected in series to each other and are wound so as to define the closed magnetic circuit. In other words, the coil element L1*a* and the coil element L1*b* are coupled to each other in an opposite phase (additive polarity coupling) and the coil element L2*a* and the coil element L2*b* are coupled to each other in an opposite phase (additive polarity coupling).

In addition, it is preferable that the coil element L1*a* and the coil element L2*a* be coupled to each other in the same phase (subtractive polarity coupling) and the coil element L1*b* and the coil element L2*b* are coupled to each other in the same phase (subtractive polarity coupling).

Figure 10:
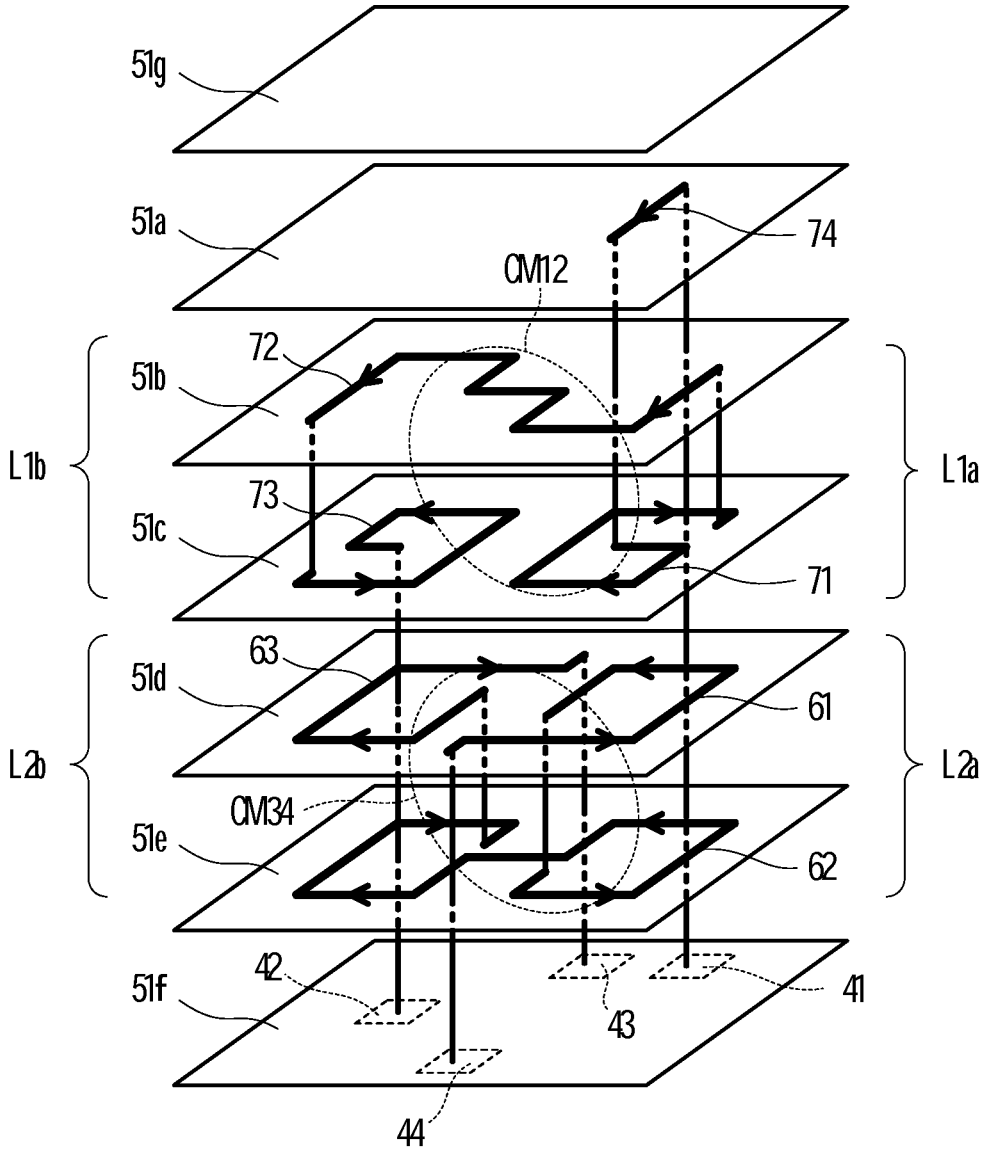
FIG. 10 is a view illustrating an example of conductor patterns of individual layers when the coupling degree adjustment circuit 24 according to the fourth preferred embodiment of the present invention is configured in a multilayer substrate.

FIG. 10 is a view illustrating an example of conductor patterns of individual layers when the coupling degree adjustment circuit 24 according to the fourth preferred embodiment of the present invention is configured in a multilayer substrate, that is a laminate in which a plurality of dielectric layers or magnetic layers are laminated on each other. Each of the individual layers is defined either by a dielectric sheet or a magnetic sheet and a conductor pattern is provided on each of base material layers 51*a* to 51*f*.

In a range illustrated in FIG. 10, a conductor pattern 74 is provided on the base material layer 51*a*. A conductor pattern 72 is provided on the base material layer 51*b*, and conductor patterns 71 and 73 are provided on the base material layer 51*c*. Conductor patterns 61 and 63 are provided on the base material layer 51*d*, a conductor pattern 62 is provided on the base material layer 51*e*, and a feeding terminal 41, a ground terminal 43, an antenna terminal 42 as a connection port of the first radiating element, and an antenna terminal 44 as a connection port of the second radiating element are provided on the lower surface of the base material layer 51*f*, respectively. Dashed lines extending vertically in FIG. 10 represent via electrodes that provide inter-layer connections between the conductor pattern and the conductor pattern.

As illustrated in FIG. 10, the right half of the conductor pattern 72, and the conductor pattern 71 define the coil element L1*a*. In a similar manner, the left half of the conductor pattern 72, and the conductor pattern 73 define the coil element L1*b*. In addition, the conductor pattern 61 and the right half of the conductor pattern 62 define the coil element L2*a*. Furthermore, the left half of the conductor pattern 62, and the conductor pattern 63 define the coil element L2*b*.

In FIG. 10, ellipses indicated by a dashed line represent closed magnetic circuits. A closed magnetic circuit CM12 interlinks with the coil elements L1*a* and L2*b*. A closed magnetic circuit CM34 also interlinks with the coil elements L2*a* and L2*b*.

In FIG. 10, since the magnetic flux passing through the closed magnetic circuit CM12 and the magnetic flux passing through the closed magnetic circuit CM34 repel each other, a magnetic barrier is generated between the closed magnetic circuits CM12 and CM34. This magnetic barrier increases the confinement property of the magnetic flux of the closed magnetic circuits CM12 and CM34. As a result, it is possible to cause the magnetic barrier to act as a transformer having a sufficiently large coupling coefficient.

In addition, the coil element L1*a* and the coil element L2*a* are also coupled to each other through an electric field. Similarly, the coil element L1*b* and the coil element L2*b* are coupled to each other through the electric field. Accordingly, when alternating-current signals flow in the coil element L1*a* and the coil element L1*b*, electric-field coupling causes currents to be excited in the coil element L2*a* and the coil element L2*b*.

When an alternating current flows in the first coil element L1, the direction of a current flowing in the second coil element L2 as a result of the coupling the magnetic field and the direction of a current flowing in through the second coil element L2 as a result of the coupling through the electric field are the same. Thus, the first coil element L1 and the second coil element L2 are strongly coupled to each other through both the magnetic field and the electric field.

Fifth Preferred Embodiment

Figure 11:
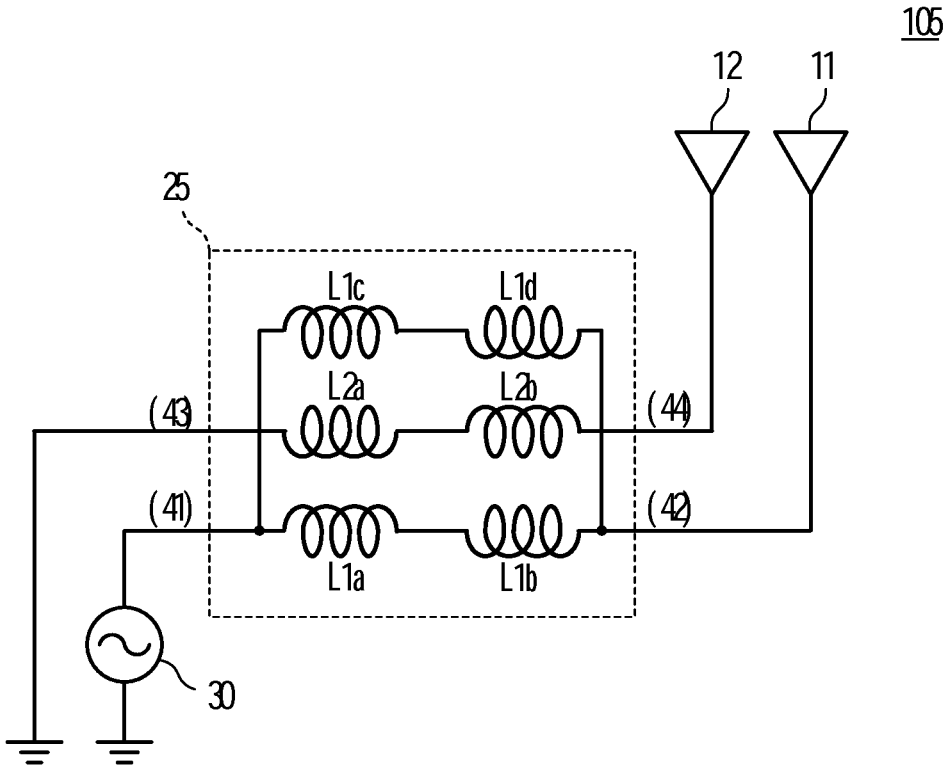
FIG. 11 is a circuit diagram of an antenna device 105 equipped with a coupling degree adjustment circuit 25 of a fifth preferred embodiment of the present invention.

FIG. 11 is a circuit diagram of an antenna device 105 equipped with a coupling degree adjustment circuit 25 of a fifth preferred embodiment of the present invention. In the fifth preferred embodiment, the primary side coil of the coupling degree adjustment circuit 25 preferably includes four coil elements L1*a*, L1*b*, L1*c*, and L1*d*, and a secondary side coil preferably includes two coil elements L2*a* and L2*b*. The primary side circuit of the coupling degree adjustment circuit 25 is connected in series between the feeding circuit 30 and the first radiating element 11, and the second radiating element 12 is connected to the secondary side circuit of the coupling degree adjustment circuit 25.

The coil elements L1*a* and L1*b* are electromagnetically coupled to each other in opposite phases. In addition, the coil elements L1*c* and Lid are electromagnetically coupled to each other in opposite phases. Furthermore, the coil elements L2*a* and L2*b* are electromagnetically coupled to each other in opposite phases. The coil elements L2*a* and L1*a* are electromagnetically coupled to each other in the same phase and the coil elements L2*a* and L1*c* are also electromagnetically coupled to each other in the same phase. In addition, the coil elements L2*b* and L1*b* are electromagnetically coupled to each other in the same phase and the coil elements L2*b* and Lid are also electromagnetically coupled to each other in the same phase.

Figure 12:
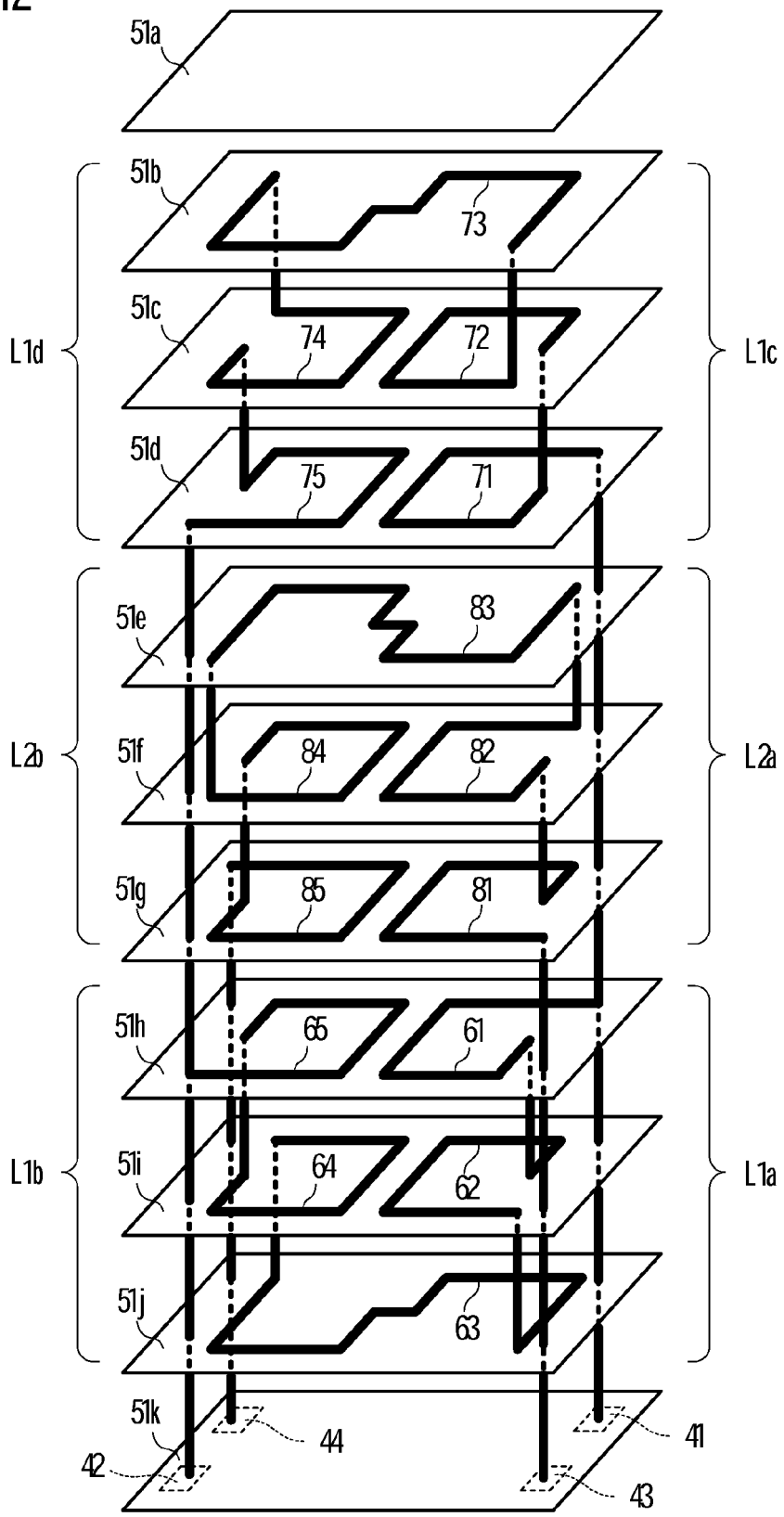
FIG. 12 is an exploded perspective view of the coupling degree adjustment circuit 25 of the fifth preferred embodiment of the present invention.

FIG. 12 is an exploded perspective view of the coupling degree adjustment circuit 25 of the fifth preferred embodiment of the present invention. As illustrated in FIG. 12, base material layers 51*a* to 51*k* are each defined by a magnetic sheet, and a conductor pattern is provided on each of the base material layers 51*b* to 51*k*. A conductor pattern 73 is provided on the base material layer 51*b*, conductor patterns 72 and 74 are provided on the base material layer 51*c*, conductor patterns 71 and 75 are provided on the base material layer 51*d*, a conductor pattern 83 is provided on the base material layer 51*e*, conductor patterns 82 and 84 are provided on the base material layer 51*f*, conductor patterns 81 and 85 are provided on the base material layer 51*g*, conductor patterns 61 and 65 are provided on the base material layer 51*h*, conductor patterns 62 and 64 are provided on the base material layer 51*i*, and a conductor pattern 63 is provided on the base material layer 51*j*. On the lower surface of the base material layer 51*k*, a feeding terminal 41, a ground terminal 43, an antenna terminal 42 as a connection port of the first radiating element, an antenna terminal 44 as a connection port of the second radiating element, and the like are provided. Lines extending vertically in FIG. 12 represent via electrodes that provide inter-layer connections between the conductor pattern and the conductor pattern.

In FIG. 12, the conductor patterns 61 to 65 define the coil elements L1*a* and L1*b*, and the conductor patterns 71 to 75 define the coil elements L1*c* and L1*d*. In addition, the conductor patterns 81 to 85 define the coil elements L2*a* and L2*b*.

In this fifth preferred embodiment of the present invention, the secondary side coils (L2*a*, L2*b*) are disposed so as to be sandwiched by the primary side coils (L1*a*, L1*b*) and (L1C, L1*d*), so that the primary side coils (L1*a*, L1*b*, L1*c*, L1*d*) and the secondary side coils (L2*a*, L2*b*) are more tightly coupled. That is, the leakage magnetic field is reduced and the energy transmission loss of high-frequency signals between the primary side coils and the secondary side coils is reduced.

Sixth Preferred Embodiment

Figure 13:
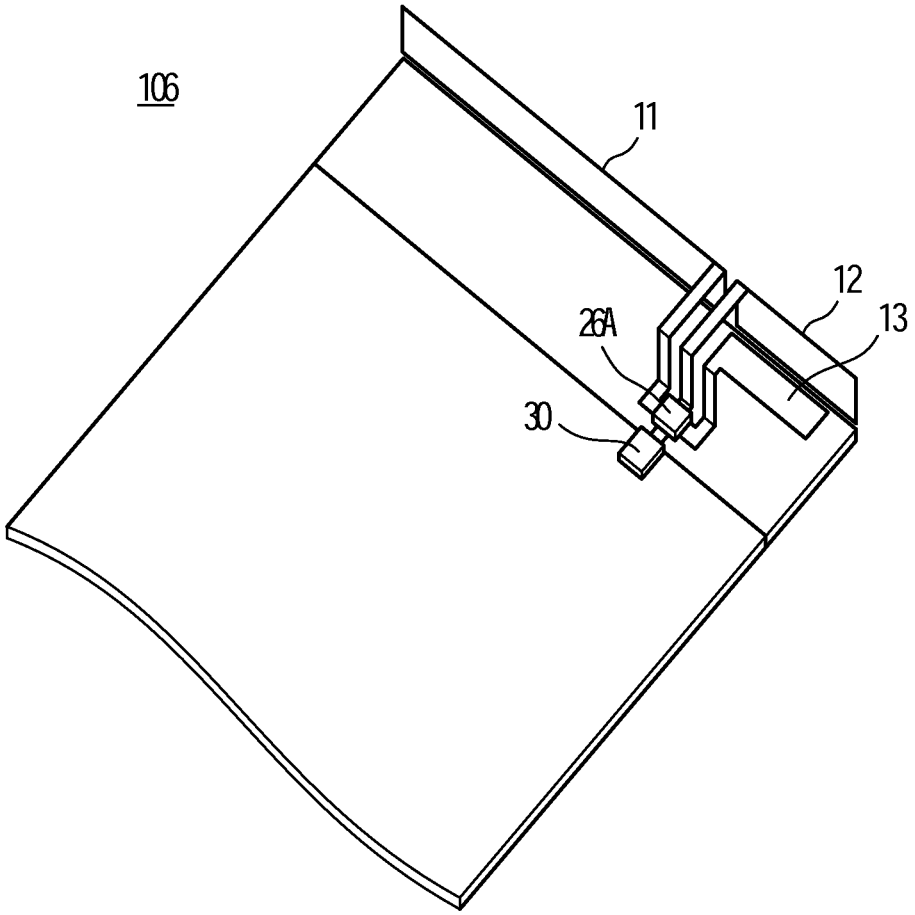
FIG. 13 is a perspective view of a main portion of an antenna device 106 according to a sixth preferred embodiment of the present invention.
Figure 14:
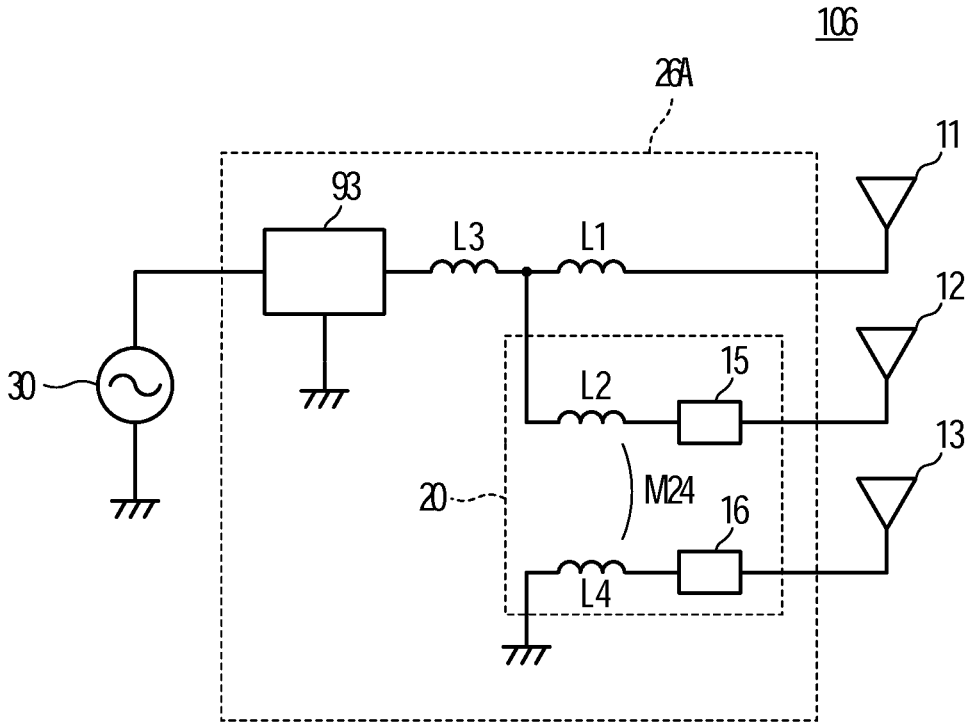
FIG. 14 is a circuit diagram of the antenna device 106.

FIG. 13 is a perspective view of a main portion of an antenna device 106 according to a sixth preferred embodiment of the present invention. FIG. 14 is a circuit diagram of the antenna device 106.

According to the sixth preferred embodiment of the present invention, a first radiating element 11, a second radiating element 12, and a third radiating element 13 are provided. A coupling degree adjustment circuit 26A is connected between the feeding portion of these radiating elements 11, 12, and 13, and a feeding circuit 30.

The coupling degree adjustment circuit 26A includes a matching circuit 93, a coupling element 20, and coil elements L1 and L3. The coupling element 20 includes a primary side circuit including a coil element L2 and a secondary side circuit including a coil element L4, and the coil element L2 and the coil element L4 are electromagnetically coupled to each other. A reactance element 15 is inserted between the coil element L2 and the second radiating element 12. Similarly, a reactance element 16 is inserted between the coil element L4 and the third radiating element 13.

Between the first radiating element 11 and a matching circuit 93, a series circuit defined by the coil elements L1 and L3 is connected, and the coupling element 20 is connected between the connection point and ground.

By the circuit illustrated in FIG. 14, the degree of coupling between the second radiating element 12 and the third radiating element 13 can be defined by mutual induction M24 between the coil elements L2 and L4 of the coupling element 20.

Figure 15:
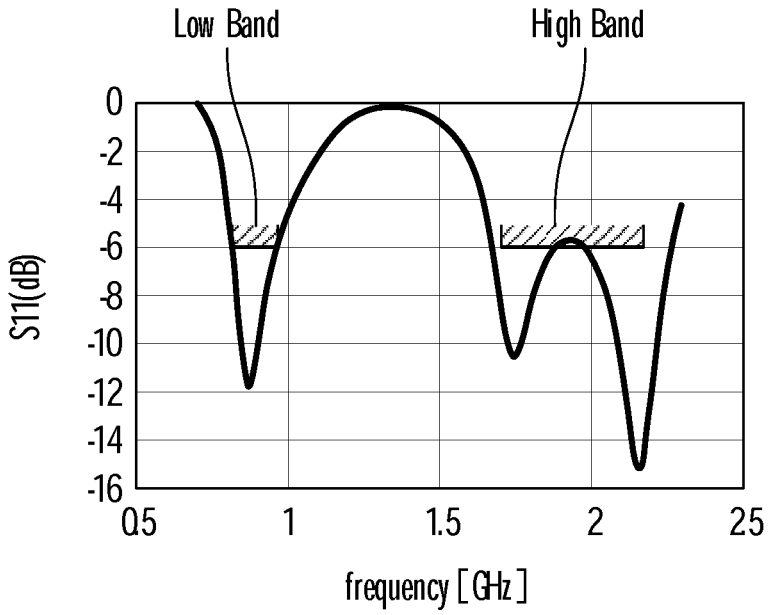
FIG. 15 shows a return loss characteristic of the antenna device 106 as viewed from a feeding circuit.

FIG. 15 shows a return loss characteristic of the antenna device 106 as viewed from the feeding circuit. In FIG. 15, "Low Band" indicates a return loss characteristic by the first radiating element 11 and "High Band" indicates a return loss characteristic by the second radiating element 12 and the third radiating element 13. In other words, the first radiating element 11 covers a low band, and the second radiating element 12 and the third radiating element 13 cover a high band. The bandwidth of the high band can be defined by a length of the second radiating element 12, a length of the third radiating element 13, a reactance of the reactance elements 15 and 16, and a degree of coupling of the coupling element 20.

In this way, a plurality of radiating elements may be connected to the primary side circuit of a coupling degree adjustment circuit (26A). In addition, the plurality of radiating elements may be connected to the secondary side circuit of the coupling degree adjustment circuit.

Seventh Preferred Embodiment

Figure 16:
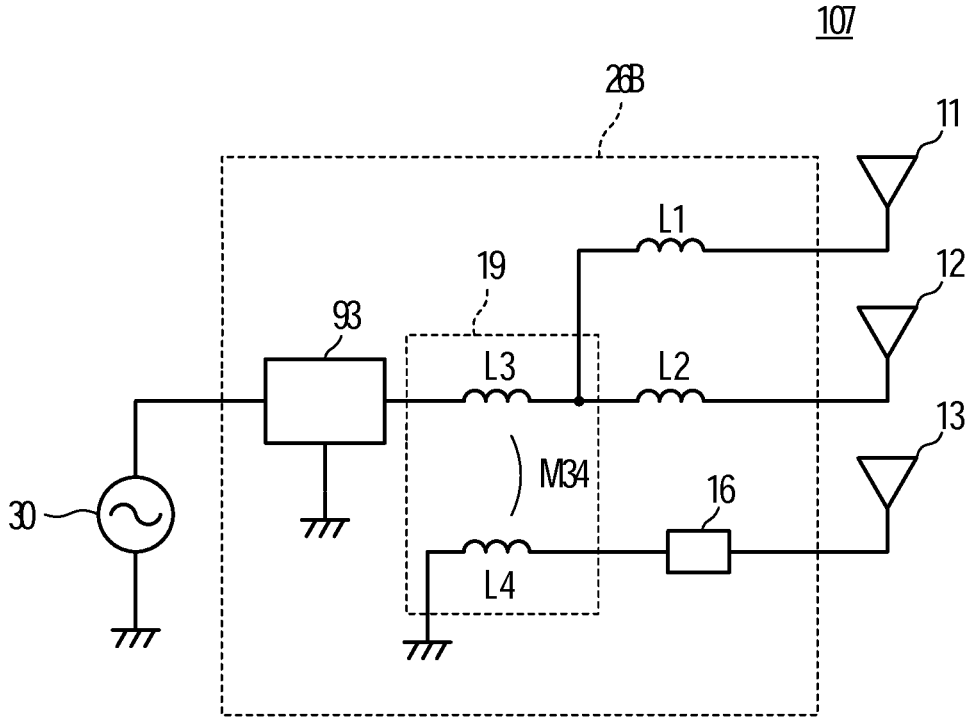
FIG. 16 is a circuit diagram of an antenna device 107 according to a seventh preferred embodiment of the present invention.

FIG. 16 is a circuit diagram of an antenna device 107 according to a seventh preferred embodiment of the present invention. According to the seventh preferred embodiment of the present invention, three radiating elements 11, 12, and 13 are provided. A coupling degree adjustment circuit 26B is connected between the feeding portion of these radiating elements 11, 12, and 13, and a feeding circuit 30.

The coupling degree adjustment circuit 26B includes a matching circuit 93, a coupling element 19, and coil elements L1 and L2. The coupling element 19 includes a primary side circuit including a coil element L3 and a secondary side circuit including a coil element L4, and the coil element L3 and the coil element L4 are electromagnetically coupled to each other. A reactance element 16 is inserted between the coil element L4 and the third radiating element 13.

The coil element L1 is connected between the first radiating element 11 and the coupling element 19, and the coil element L2 is connected between the second radiating element 12 and the coupling element 19.

The first radiating element 11, the second radiating element 12, and the third radiating element 13 cover a predetermined frequency band, respectively. For example, the first radiating element 11 covers a low band, and the second radiating element 12 and the third radiating element 13 cover a high band. The bandwidth of the high band can be defined by a length of the second radiating element 12, a length of the third radiating element 13, a reactance of the reactance element 16, an inductance of the coil element L2, and a degree of coupling of the coupling element 19.

With the above configuration, two or more plurality of radiating elements may be connected to the primary side circuit or the secondary side circuit of the coupling degree adjustment circuit.

Eighth Preferred Embodiment

Figure 17:
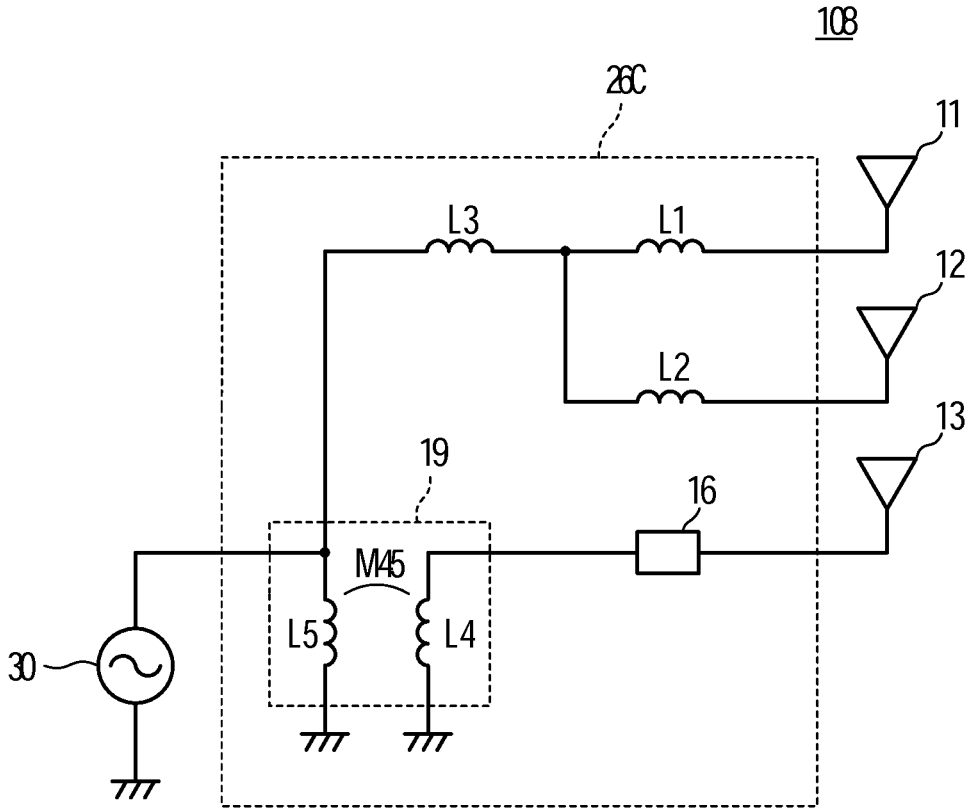
FIG. 17 is a circuit diagram of an antenna device 108 according to an eighth preferred embodiment of the present invention.

FIG. 17 is a circuit diagram of an antenna device 108 according to an eighth preferred embodiment of the present invention. According to the eighth preferred embodiment of the present invention, three radiating elements 11, 12, and 13 are provided. A coupling degree adjustment circuit 26C is connected between a feeding portion of these radiating elements 11, 12, and 13, and a feeding circuit 30.

The coupling degree adjustment circuit 26C includes a coupling element 19 and coil elements L1, L2 and L3. The coupling element 19 includes a primary side circuit including a coil element L5 and a secondary side circuit including a coil element L4, and the coil element L5 and the coil element L4 are electromagnetically coupled to each other. A reactance element 16 is inserted between the coil element L4 and the third radiating element 13.

The coil elements L1 and L3 are connected between the first radiating element 11 and the coupling element 19, and the coil elements L2 and L3 are connected between the second radiating element 12 and the coupling element 19. The coil elements L1, L2, and L3 function both as a branch circuit and a matching circuit.

The first radiating element 11, the second radiating element 12, and the third radiating element 13 cover a predetermined frequency band, respectively. For example, the first radiating element 11 covers a low band, and the second radiating element 12 and the third radiating element 13 cover a high band.

The bandwidth of the high band can be defined by a length of the second radiating element 12, a length of the third radiating element 13, a reactance of the reactance elements 16, an inductance of the coil elements L2 and L3, and a degree of coupling of the coupling element 19.

In this way, a matching circuit may be provided on a side of the radiating element of the primary side circuit of the coupling degree adjustment circuit.

Ninth Preferred Embodiment

Figure 18:
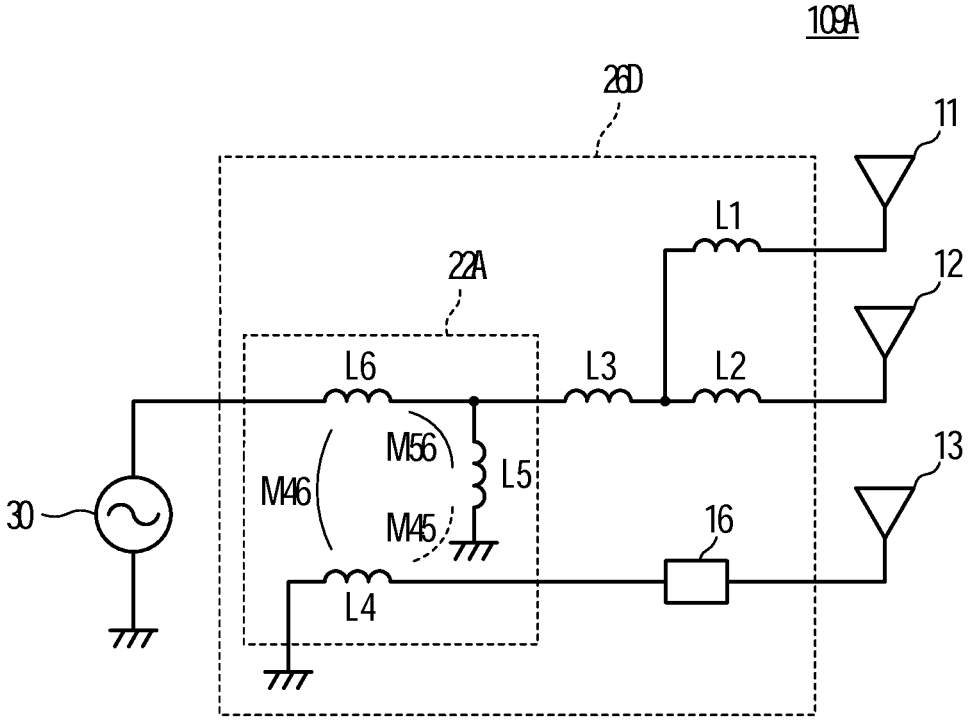
FIG. 18 is a circuit diagram of an antenna device 109 according to a ninth preferred embodiment of the present invention.

FIG. 18 is a circuit diagram of an antenna device 109A according to a ninth preferred embodiment of the present invention. According to the ninth preferred embodiment of the present invention, three radiating elements 11, 12, and 13 are provided. A coupling degree adjustment circuit 26D is connected between the feeding portion of these radiating elements 11, 12, and 13, and a feeding circuit 30.

The coupling degree adjustment circuit 26D includes a coupling element 22A and coil elements L1, L2 and L3. The coupling element 22A includes a primary side circuit including coil elements L5 and L6 and a secondary side circuit including a coil element L4, and the coil element L6 and the coil element L4 are electromagnetically coupled to each other. A reactance element 16 is inserted between the coil element L4 and the third radiating element 13.

The coil elements L1 and L3 are connected between the first radiating element 11 and the coupling element 22A, and the coil elements L2 and L3 are connected between the second radiating element 12 and the coupling element 22A. The coil elements L1, L2, and L3 function both as a branching circuit and a matching circuit.

Of the three coil elements L4, L5, and L6 that define the coupling element 22A, mutual induction M46 between the coil elements L6-L4, mutual induction M56 between the coil elements L6-L5, and mutual induction M45 between the coil elements L5-L4 are generated. An impedance of the primary side circuit, an impedance of the secondary side circuit, and a degree of coupling can be defined by the three coil elements L4, L5, and L6 and the mutual induction M46, M56, and M45.

The first radiating element 11, the second radiating element 12, and the third radiating element 13 cover a predetermined frequency band, respectively. For example, the first radiating element 11 covers a low band, and the second radiating element 12 and the third radiating element 13 cover a high band. The bandwidth of the high band can be defined by a length of the second radiating element 12, a length of the third radiating element 13, a reactance of the reactance elements 16, an inductance of the coil elements L2 and L3, and a degree of coupling of the coupling element 22A.

In this way, a coupling element may be defined by three or more coil elements.

Figure 19:
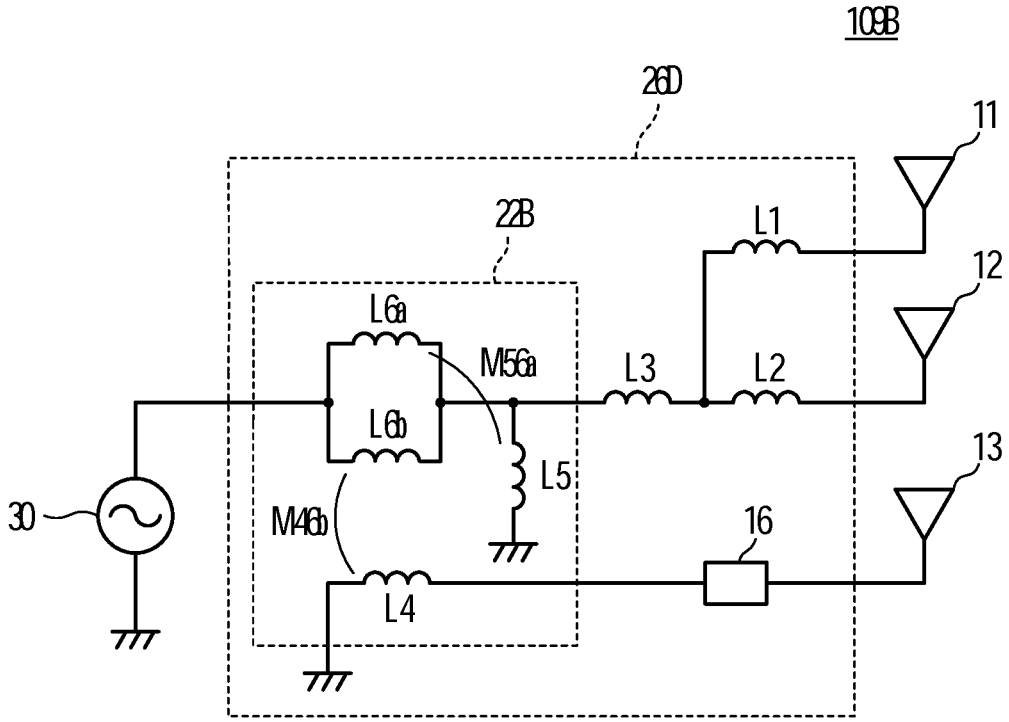
FIG. 19 is a circuit diagram of a coupling element 22B of which a configuration is different from the configuration of the coupling element illustrated in FIG. 18.

FIG. 19 is a circuit diagram of an antenna device 109B equipped with a coupling element 22B of which the configuration differs from the configuration of the coupling element 22A. The coil elements L6*a*, L6*b*, and L5 are provided in the primary side circuit. In other words, the coil element L6 illustrated in FIG. 18 is divided into coil elements L6*a* and L6*b*, and the coil element L6*a* and the coil element L5 are coupled to each other and the coil element L6*b* and the coil element L4 are coupled to each other. As described above, a coupling amount and an inductance may be configured to be set up individually.

Tenth Preferred Embodiment

Figure 20:
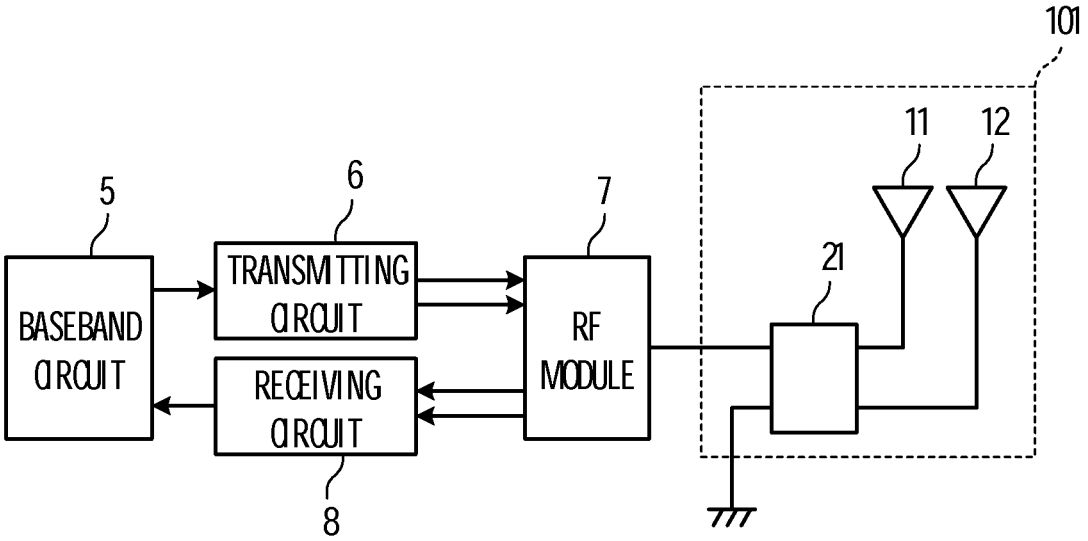
FIG. 20 is a block diagram illustrating a configuration of a communication terminal apparatus of a tenth preferred embodiment of the present invention.

FIG. 20 is a block diagram illustrating a configuration of a communication terminal apparatus of a tenth preferred embodiment of the present invention. This communication terminal apparatus is a mobile phone terminal, for example, and is equipped with an antenna device 101, a high frequency circuit module 7, a transmitting circuit 6, a receiving circuit 8, and a baseband circuit 5. The antenna device 101 includes a coupling degree adjustment circuit 21, and a first radiating element 11 and a second radiating element 12. The high frequency circuit module 7 is equipped with a high frequency switch that switches transmitting signals in a low band and a high band and received signals in a low band and a high band and a demultiplexing/multiplexing circuit. The transmitting circuit 6 includes a transmitting circuit for a low band, and a transmitting circuit for a high band. In addition, the receiving circuit 8 includes a receiving circuit for a low band, and a receiving circuit for a high band.

While the coupling degree adjustment circuit 21 preferably is the coupling degree adjustment circuit 21 disclosed in the first preferred embodiment or the second preferred embodiment of the present invention, the coupling degree adjustment circuits described in the third to the ninth preferred embodiments of the present invention, other than this circuit, may also be used. It should be noted that the coupling degree adjustment circuit 21 embedded in the high frequency circuit module 7 may define one module.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A coupling degree adjustment circuit comprising:

a primary side circuit that includes a first coil element and is connected to a first radiating element; and a secondary side circuit that includes a second coil element electromagnetically coupled to the first coil element, and is connected to a second radiating element.

2. The coupling degree adjustment circuit according to claim 1, wherein the first coil element and the second coil element are integrally configured in a laminate including a plurality of dielectric layers or magnetic layers laminated on each other.

3. The coupling degree adjustment circuit according to claim 1, wherein:

the first coil element includes a plurality of coil conductors that are interconnected in series and arranged adjacent to each other so as to define a closed magnetic circuit; and the second coil element includes a plurality of coil conductors that are interconnected in series and arranged adjacent to each other so as to define a closed magnetic circuit.

4. The coupling degree adjustment circuit according to claim 1, wherein the primary side circuit comprises a matching circuit connected between the first coil element and a connection port of the first radiating element or between the second coil element and a connection port of the second radiating element.

5. The coupling degree adjustment circuit according to claim 1, wherein the primary side circuit comprises a matching circuit connected between a feeding port to which a feeding circuit is connected and the second radiating element.

6. The coupling degree adjustment circuit according to claim 1, wherein the primary side circuit comprises a matching circuit connected between the first coil element and ground.

7. The coupling degree adjustment circuit according to claim 1, wherein the secondary side circuit comprises a matching circuit connected between the second coil element and the ground.

8. The coupling degree adjustment circuit according to claim 1, further comprising a matching circuit connected between the primary side circuit and the secondary side circuit.

9. The coupling degree adjustment circuit according to claim 1, wherein:

the first radiating element is connected to a feeding circuit;

the second radiating element is connected to ground;

the first radiating element and the second radiating element are included in a multiple resonant antenna; and a degree of coupling between the first radiating element and the second radiating element is adjustable.

10. An antenna device comprising:

a first radiating element;

a second radiating element; and a coupling degree adjustment circuit connected between the first radiating element and the second radiating element, and a feeding circuit, the coupling degree adjustment circuit including:

a primary side circuit that includes a first coil element and is connected to the first radiating element; and a secondary side circuit that includes a second coil element electromagnetically coupled to the first coil element, and is connected to the second radiating element.

11. The antenna device according to claim 10, wherein a degree of coupling between the primary side circuit and the secondary side circuit is higher than a degree of coupling between the first radiating element and the second radiating element not through the coupling degree adjustment circuit.

12. The antenna device according to claim 10, wherein the first coil element and the second coil element are integrally configured in a laminate including a plurality of dielectric layers or magnetic layers laminated on each other.

13. The antenna device according to claim 10, wherein:

the first coil element includes a plurality of coil conductors that are interconnected in series and arranged adjacent to each other so as to define a closed magnetic circuit; and the second coil element includes a plurality of coil conductors that are interconnected in series and arranged adjacent to each other so as to define a closed magnetic circuit.

14. The antenna device according to claim 10, wherein the primary side circuit comprises a matching circuit connected between the first coil element and a connection port of the first radiating element or between the second coil element and a connection port of the second radiating element.

15. The antenna device according to claim 10, wherein the primary side circuit comprises a matching circuit connected between a feeding port to which a feeding circuit is connected and the second radiating element.

16. The antenna device according to claim 10, wherein the primary side circuit comprises a matching circuit connected between the first coil element and ground.

17. The antenna device according to claim 10, wherein the secondary side circuit comprises a matching circuit connected between the second coil element and the ground.

18. The antenna device according to claim 10, further comprising a matching circuit connected between the primary side circuit and the secondary side circuit.

19. A communication terminal apparatus comprising:

an antenna device including:

a first radiating element;

a second radiating element; and a coupling degree adjustment circuit connected between the first radiating element and the second radiating element, and a feeding circuit, the coupling degree adjustment circuit including:

a primary side circuit that includes a first coil element and is connected to the first radiating element; and a secondary side circuit that includes a second coil element electromagnetically coupled to the first coil element, and is connected to the second radiating element.

20. The communication terminal apparatus according to claim 19, wherein a degree of coupling between the primary side circuit and the secondary side circuit is higher than a degree of coupling between the first radiating element and the second radiating element not through the coupling degree adjustment circuit.

* * * * *